US008024875B2

(12) United States Patent
Wetzel et al.

(10) Patent No.: US 8,024,875 B2
(45) Date of Patent: Sep. 27, 2011

(54) COMPACT EXCAVATOR IMPLEMENT INTERFACE

(75) Inventors: Michael D. Wetzel, Bismarck, ND (US); James M. Breuer, Bismarck, ND (US); Thomas M. Sagaser, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 39 days.

(21) Appl. No.: 11/292,450

(22) Filed: Dec. 2, 2005

(65) Prior Publication Data

US 2007/0124964 A1 Jun. 7, 2007

(51) Int. Cl.
*E02F 3/96* (2006.01)

(52) U.S. Cl. ..... 37/468; 37/403; 37/410

(58) Field of Classification Search ..... 37/468, 37/403, 410; 414/723
See application file for complete search history.

(56) References Cited

U.S. PATENT DOCUMENTS

| | | | | |
|---|---|---|---|---|
| 3,083,480 | A * | 4/1963 | Kirchler | 172/825 |
| 3,466,770 | A | 9/1969 | Morrison et al. | 37/117.5 |
| 4,824,319 | A * | 4/1989 | Arnold | 414/723 |
| 4,966,240 | A * | 10/1990 | Aikawa | 172/825 |
| 5,082,065 | A * | 1/1992 | Fletcher | 172/273 |
| 5,367,796 | A | 11/1994 | Bowers et al. | |
| 5,403,144 | A | 4/1995 | Staben, Jr. | |
| 5,562,397 | A * | 10/1996 | Albright | 414/723 |
| 5,590,483 | A | 1/1997 | Kim | 7/468 |
| 5,975,833 | A * | 11/1999 | Yamada et al. | 414/687 |
| 6,170,180 | B1 * | 1/2001 | Schaeff | 37/443 |
| 6,266,901 | B1 | 7/2001 | Kanda et al. | |
| 6,332,748 | B1 | 12/2001 | Doering et al. | |
| 6,389,922 | B1 * | 5/2002 | Krieger | 74/491 |
| D473,571 | S | 4/2003 | Kuwae et al. | D15/25 |
| 6,615,942 | B2 * | 9/2003 | Shinohara et al. | 180/69.21 |
| 6,668,471 | B1 | 12/2003 | Cook et al. | 37/410 |
| 6,804,903 | B1 * | 10/2004 | Cooper | 37/352 |
| 6,860,707 | B2 * | 3/2005 | Roan et al. | 414/723 |
| 6,886,277 | B2 * | 5/2005 | Yukawa et al. | 37/347 |
| 7,108,475 | B1 * | 9/2006 | Gustafson | 414/723 |
| 7,320,380 | B2 * | 1/2008 | Ueda et al. | 180/327 |
| 2001/0026080 | A1 * | 10/2001 | Murakami | 296/190.08 |
| 2004/0060747 | A1 * | 4/2004 | Wetzel et al. | 180/9.44 |
| 2004/0068984 | A1 | 4/2004 | Wetzel et al. | 60/486 |
| 2007/0134081 | A1 * | 6/2007 | Seabolt | 414/723 |

FOREIGN PATENT DOCUMENTS

EP 1452650 A1 1/2004

(Continued)

OTHER PUBLICATIONS

Office Action dated Mar. 1, 2010 for European Patent Application No. 06838565.7-1256, based on PCT/US2006/045677.

(Continued)

*Primary Examiner* — Thomas Will
*Assistant Examiner* — Mai Nguyen
(74) *Attorney, Agent, or Firm* — Leanne Taveggia Farrell; Westman, Champlin & Kelly, P.A.

(57) ABSTRACT

A compact excavator includes a base frame, an upper frame and first and second track assemblies supporting the base frame. The compact excavator also includes a primary implement assembly coupled to the upper frame and a secondary implement assembly. The secondary implement assembly includes a lift arm assembly pivotally coupled to the base frame and an implement coupler pivotally coupled to the lift arm assembly. The implement coupler is configured to latch an implement to the lift arm assembly.

16 Claims, 6 Drawing Sheets

FOREIGN PATENT DOCUMENTS

| | | |
|---|---|---|
| JP | 1176161 U | 12/1989 |
| JP | 4353127 | 12/1992 |
| JP | 9158236 | 6/1997 |
| JP | 11280118 | 10/1999 |

OTHER PUBLICATIONS

Office Action dated Jul. 14, 2010 for Chinese Patent Application No. 20068045170.5, based on PCT/US2006/045677.

Communication dated Oct. 8, 2010 for European patent application No. 06838565.7, filed Nov. 29, 2006.

Communication from European Patent Office dated Apr. 28, 2011 for European application No. 06 83 8565.7, filed Nov. 29, 2006.

Office Action dated Jan. 26, 2011, issued in Chinese application No. 200680045170.5, filed Nov. 29, 2006, based on PCT/US2006/045677. English translation attached to original.

* cited by examiner

COMPACT EXCAVATOR IMPLEMENT INTERFACE

BACKGROUND OF THE INVENTION

The present invention relates to compact excavators or mini-excavators. More particularly, the present invention relates to an implement assembly for a compact excavator.

Compact excavators (also known as mini-excavators) are currently in wide use. A mini-excavator is a tracked excavator having an operating weight of less than six tons. A base frame of the compact excavator includes an undercarriage frame that is supported by a pair of track assemblies. An upper frame of the compact excavator includes an operator support portion having a cab. The pair of track assemblies are powered by hydraulic motors and are controlled by an operator located in the cab.

Current compact excavators are equipped with a dozer blade that is pinned to the base frame of the compact excavator. Current compact excavators are also equipped with an implement assembly including a boom and arm that are pinned to the upper frame. In general the implement assembly includes a bucket or breaker coupled to the arm that is configured for excavating and trenching. In operation, the dozer blade is used for grading, leveling, backfilling, trenching and general dozing work. The blade can be used to increase dump height and digging depth depending on its position in relation to the boom and implement assembly. The blade also serves as a stabilizer during digging operations.

Attachment mounting plates for use in compact construction equipment (other than excavators) have become increasingly popular for ease in quickly attaching various tool attachments to a loader arm. An example attachment mounting plate is shown in U.S. Pat. No. 5,562,397. In general, attachment mounting plates are configured for manual operated latching of an attachment or configured for power operated latching of an attachment. More recently, attachment mounting plates are being used in conjunction with the boom that is coupled to the upper frame of the compact excavator to easily attach different attachments, such as a bucket and an auger.

Other than for quickly attaching the bucket and other earth-moving attachments to the implement assembly, other types of attachments have not typically been used in compact excavators. In one aspect, the compact excavators were designed for the sole purpose of earth excavation. In another aspect, the drive system in the compact excavators has historically lacked the required power to utilize different types of attachments to perform various types of activities. With the development of independent drive systems in compact excavators, the multi-function usability of a compact excavator is also becoming highly desirable.

SUMMARY OF THE INVENTION

One embodiment of the present invention includes a compact excavator or mini-excavator. The compact excavator includes a base frame, an upper frame and first and second track assemblies supporting the base frame. The compact excavator also includes a first implement assembly coupled to the upper frame and a second implement assembly. The second implement assembly includes a lift arm assembly pivotally coupled to the base frame and an implement coupler pivotally coupled to the lift arm assembly. The implement coupler is configured to latch an implement to the lift arm assembly.

Another embodiment of the present invention includes an implement assembly. The implement assembly includes a lift arm assembly pivotally coupled to a base frame of a compact excavator and an implement coupler pivotally coupled to the lift arm assembly. The implement coupler is configured to latch an implement to the lift arm assembly. The implement assembly also includes an implement hydraulic actuator configured to move the implement coupler about an implement coupler pivotal axis located on the lift arm assembly.

DETAILED DESCRIPTION OF THE PREFERRED EMBODIMENTS

Figure 1:
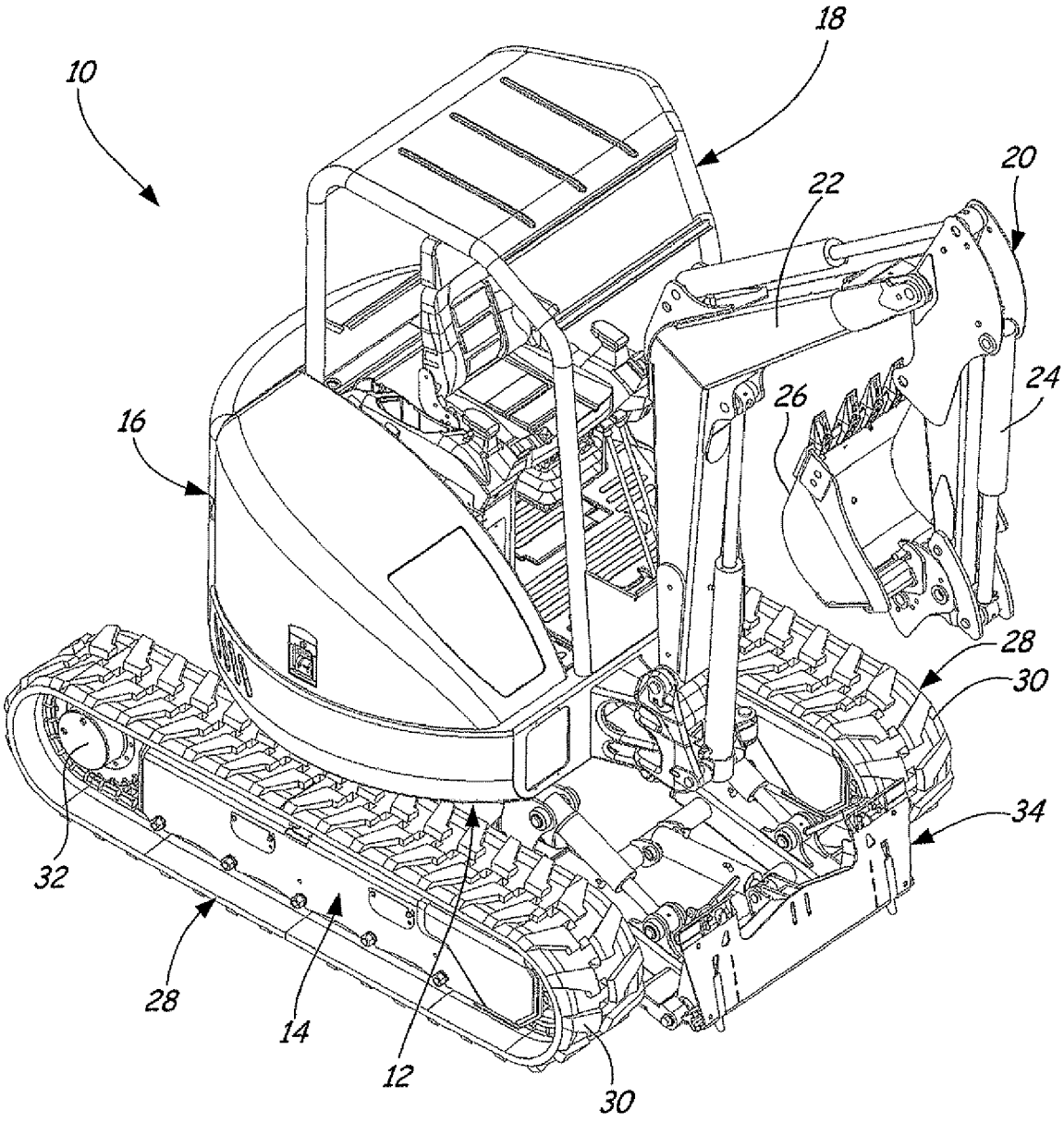
FIG. 1 illustrates a perspective of a compact excavator in accordance with an embodiment of the present invention.

FIG. 1 illustrates a perspective view of a compact excavator 10 (also known as a mini-excavator) in accordance with the present invention. Compact excavator 10 includes a base frame 12 including an undercarriage frame 14, an upper frame 16 including an operator support structure 18 and a first implement assembly 20 pinned to upper frame 16. First implement assembly 20 includes a boom 22, an arm 24 and arm mounted attachment 26. As illustrated in FIG. 1, arm mounted attachment 26 is a bucket. However, those skilled in the art will recognize that other types of attachments can be used, such as an auger.

Undercarriage frame 14 is configured to support a pair of tracking assemblies 28 located on the left and right sides of compact excavator 10. Each track assembly 28 includes a track 30 that is rotatable about a sprocket 32 (only one sprocket is shown in FIG. 1). Each sprocket 32 is powered by a drive system controlled through manipulation of suitable controls in operator support structure 18.

Figure 2:
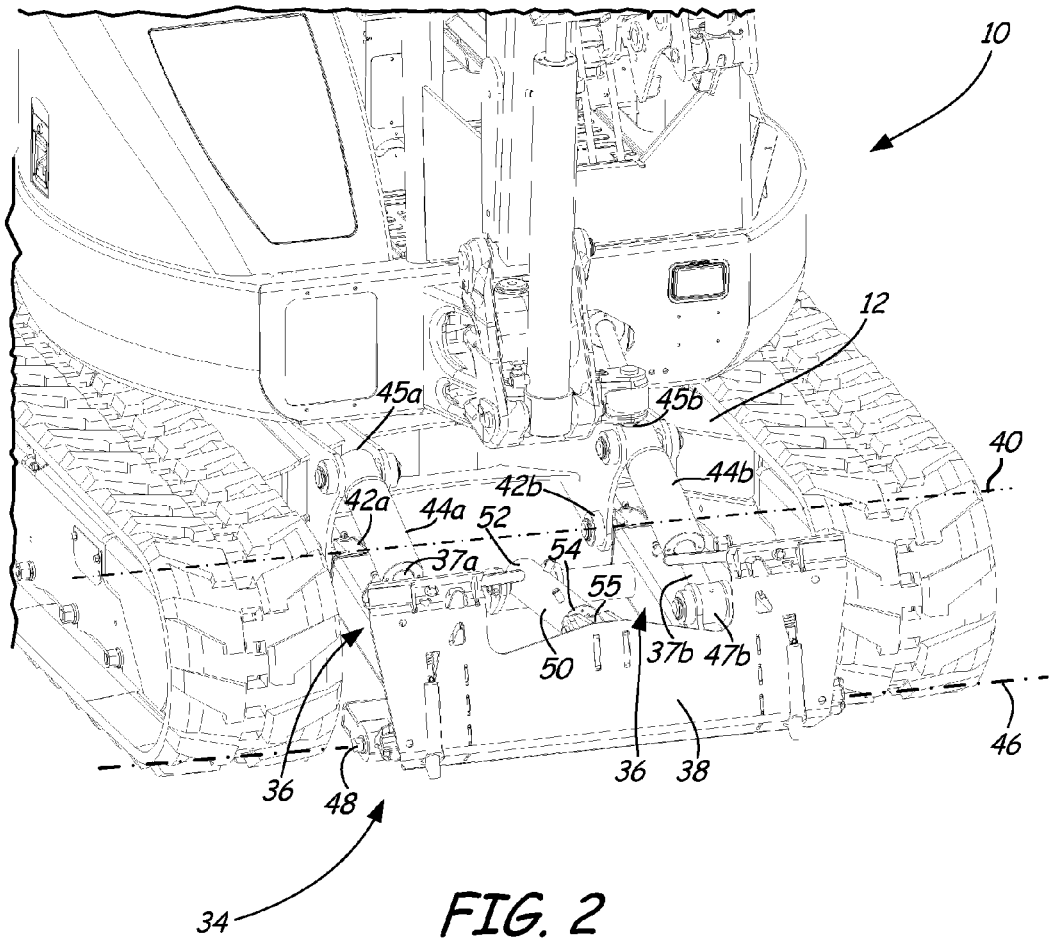
FIG. 2 illustrates an enlarged perspective view of an implement assembly in accordance with an embodiment of the present invention.

Compact excavator 10 also includes a secondary implement assembly 34. FIG. 2 illustrates an enlarged perspective view of secondary implement assembly 34 attached to base frame 12 of compact excavator 10 in accordance with an embodiment of the present invention. Secondary implement assembly 34 includes a lift arm assembly 36 and an implement coupler 38.

Figure 4:
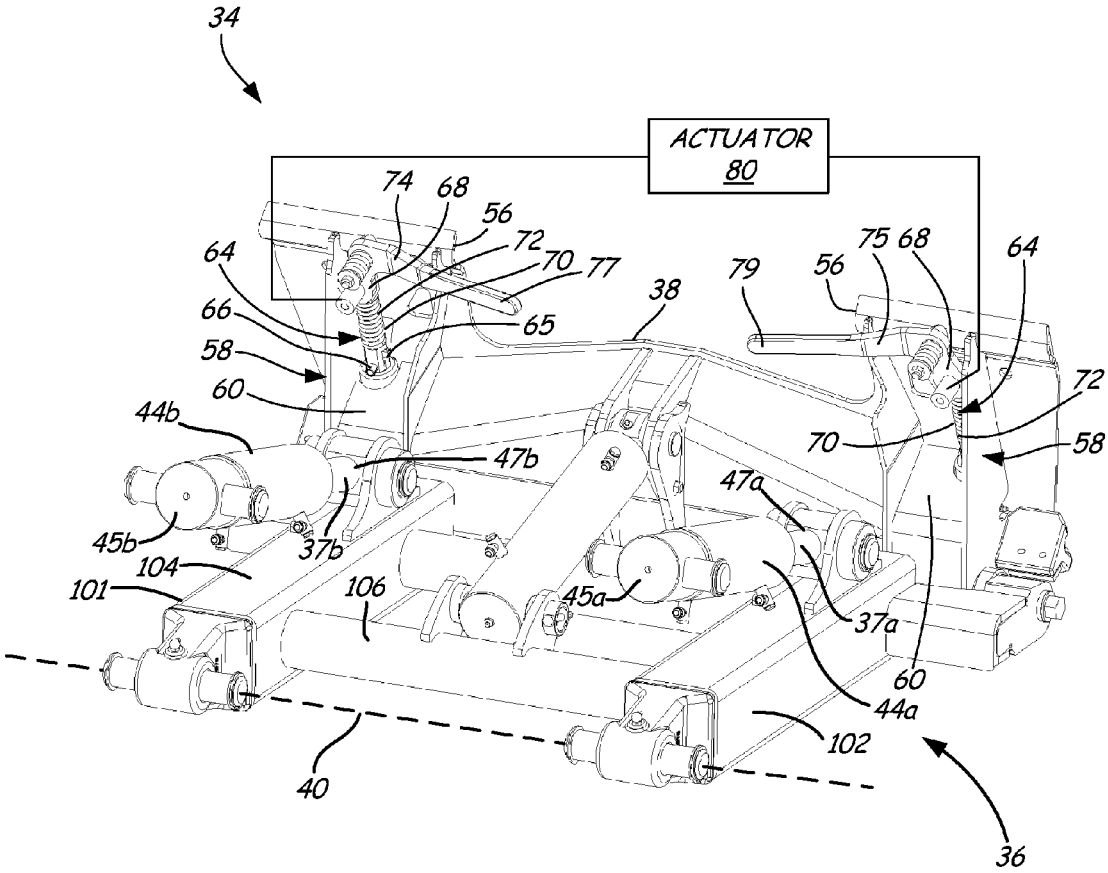
FIG. 4 illustrates a perspective view of a lift arm assembly in accordance with an embodiment of the present invention.

Lift arm assembly 36 includes a lift arm body 101 that is pivotally coupled to base frame 12 at a lift arm pivot axis 40 with pins 42*a* and 42*b*. Lift arm assembly 36 is configured to rotate through an arc centered on lift arm pivot axis 40 upon actuation by a pair of hydraulic actuators 44*a* and 44*b*. In FIG. 4, lift arm body 101 includes a first lift arm 102 and a second lift arm 104. Lift arm body 101 also includes at least one cross-support member 106 that couples the first lift arm 102 to the second lift arm 104. In both FIGS. 2 and 4, base ends 45*a* and 45*b* of hydraulic actuators 44*a* and 44*b* are pinned to base frame 12. Rod ends 47*a* and 47*b* (only one second end is shown in FIG. 2) of first and second hydraulic actuators 44*a* and 44*b* are pinned to lift arm assembly 36 at first and second lift arms 102 and 104, respectively. In one embodiment, first and second hydraulic actuators 44*a* and 44*b* are hydraulic cylinders having extendible and retractable shafts 37*a* and 37*b*.

With reference back to FIG. 2, implement coupler 38 is pivotally coupled to lift arm assembly 36 at an implement coupler pivot axis 46 with pins 48 (only one pin is shown in FIG. 2). Implement coupler 38 is configured to rotate or tilt through an arc centered on implement coupler pivot axis 46 upon actuation by a hydraulic actuator 50. A base end 52 of hydraulic actuator 50 is pinned to lift arm assembly 36. A rod end 54 of hydraulic actuator 50 is pinned to implement coupler 38. In one embodiment, hydraulic actuator 50 is a hydraulic cylinder having an extendible and a retractable shaft 55.

Figure 3:
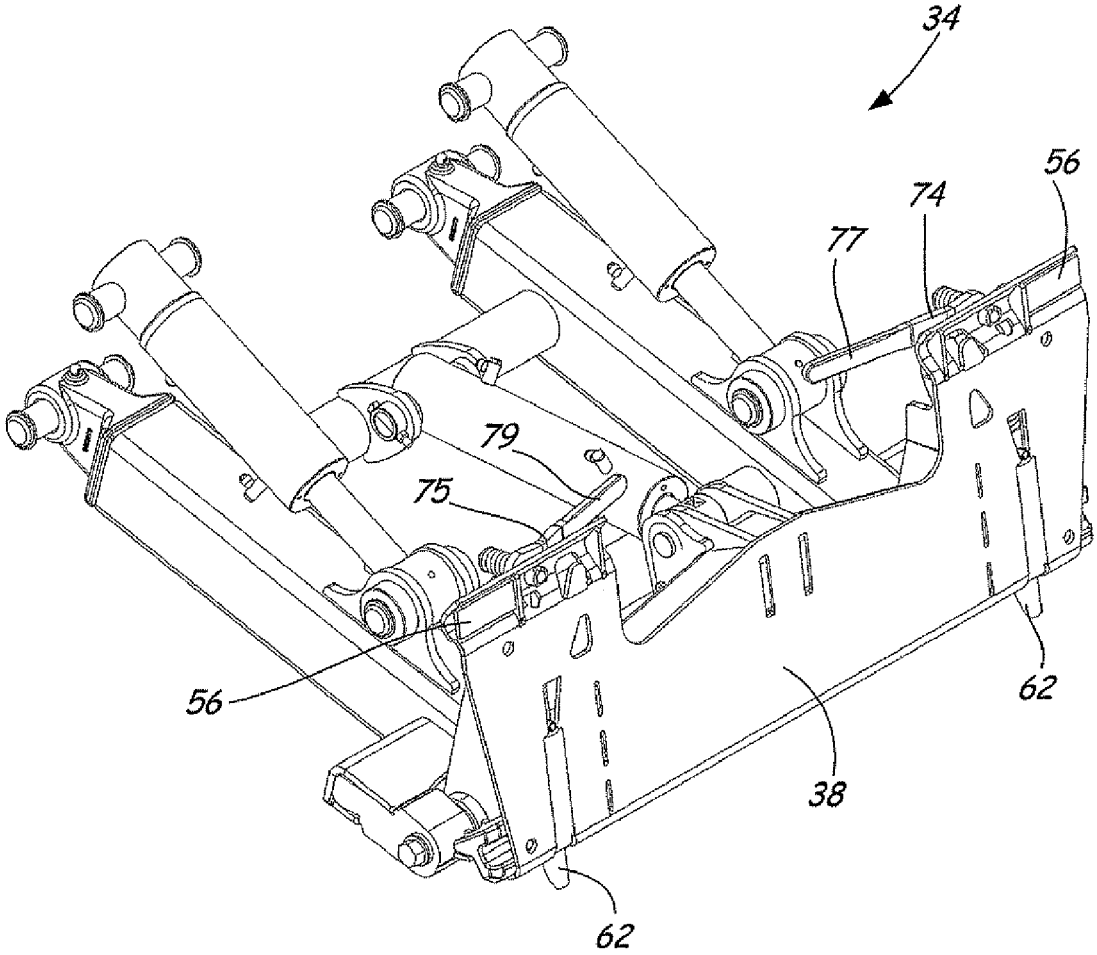
FIG. 3 illustrates a perspective view of a lift arm assembly in accordance with an embodiment of the present invention.
Figure 5:
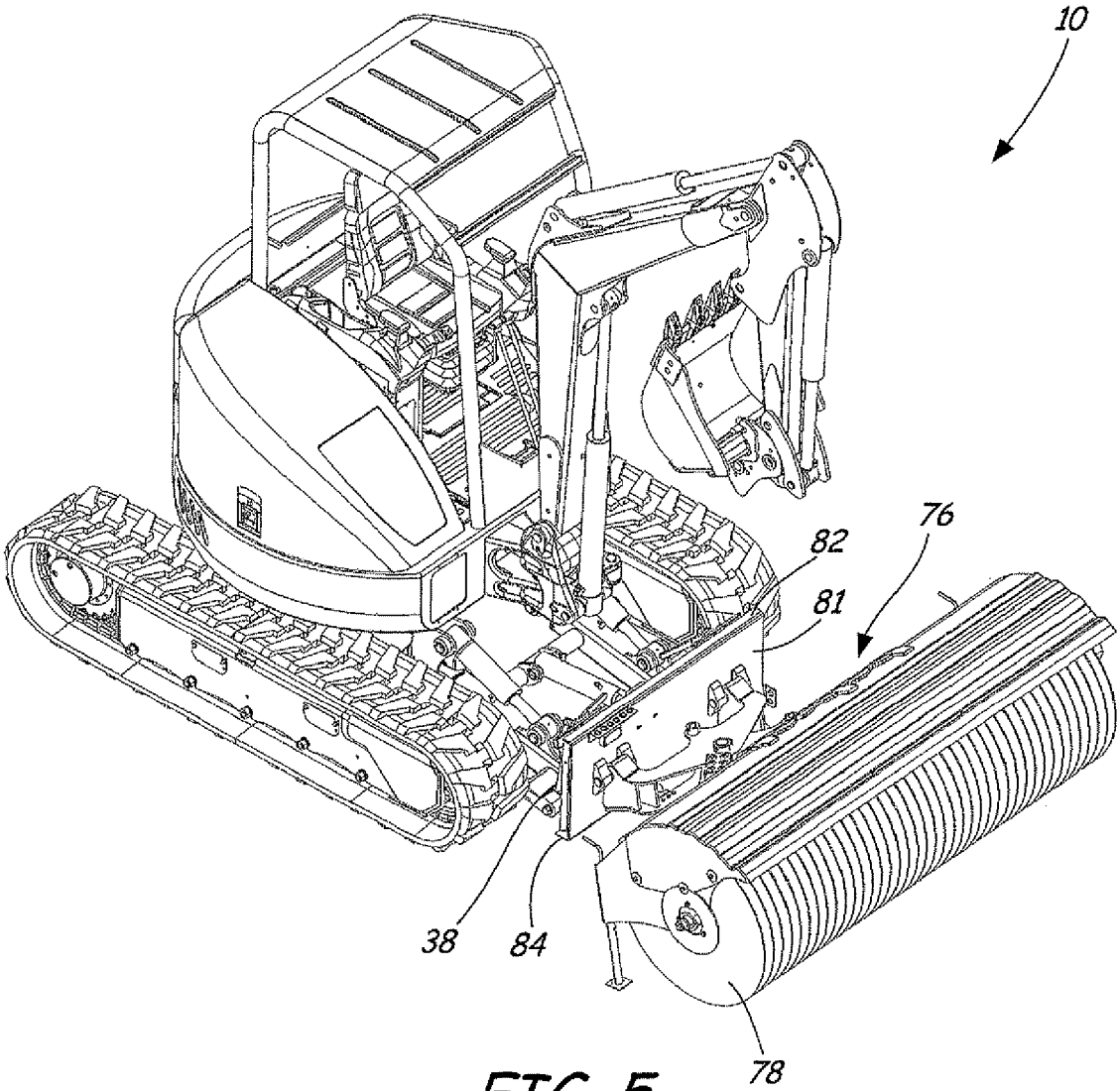
FIG. 5 illustrates a perspective view of a compact excavator including an implement attached to an implement coupler in accordance with an embodiment of the present invention.
Figure 6:
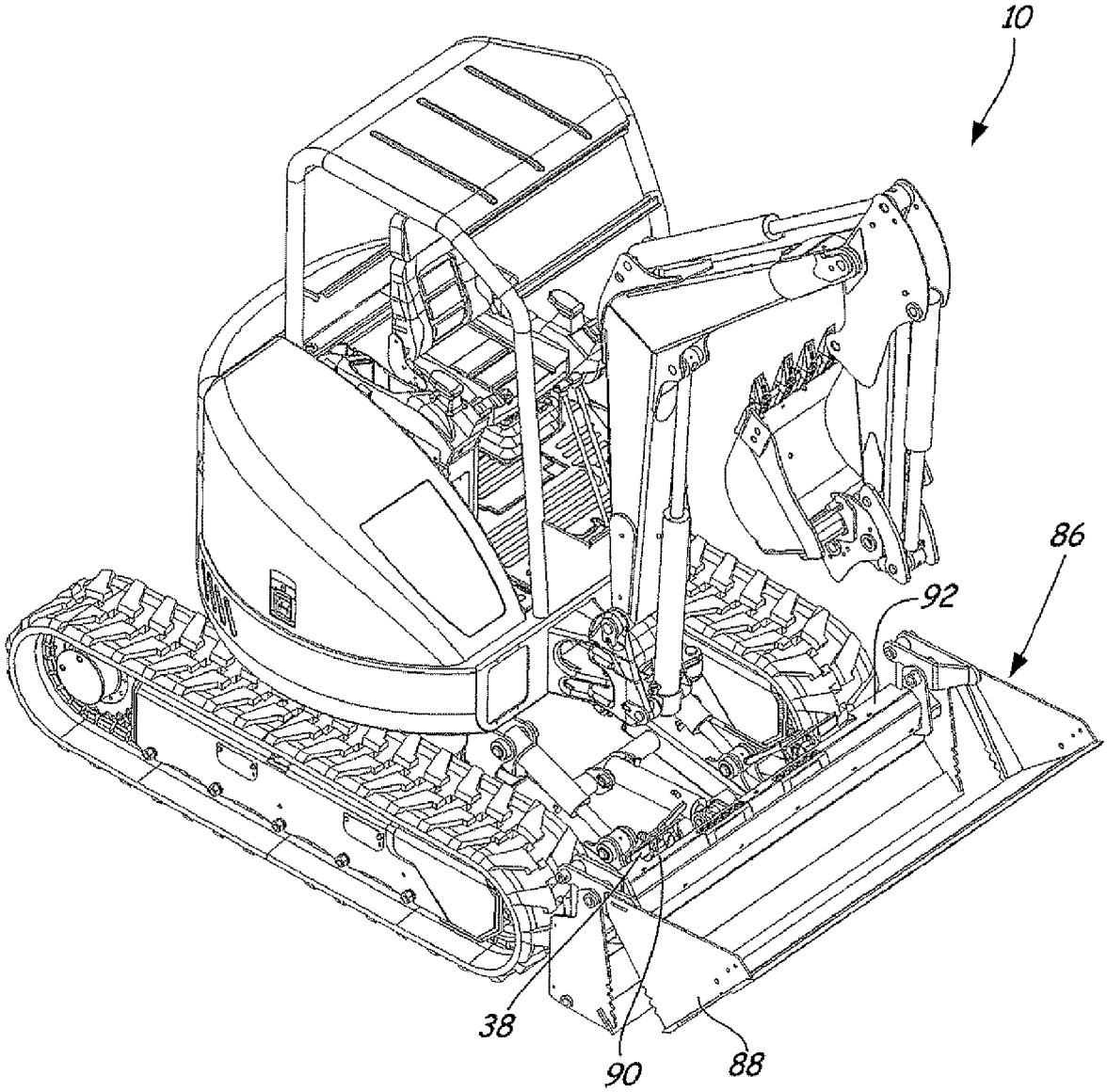
FIG. 6 illustrates a perspective view of a compact excavator including an implement attached to an implement coupler in accordance with an embodiment of the present invention.

FIGS. 3 and 4 illustrate front and back perspective views of second implement assembly 34 in accordance with embodiments of the present invention. Implement coupler 38 allows for the quick connection of implements or attachments to lift arm assembly 34. Implement coupler 38 includes a lip 56 that is configured to fit with a flange of an implement. Implement coupler 38 includes a pair of levers 74 and 75 and wedge housings 58. Each lever 74 and 75 and wedge housing 58 includes a guide plate 60 in which is mounted a sliding wedge 62. Each wedge 62 is configured to move up and down in a vertical direction and has a tapered edge to aid in pushing the wedge into a desired aperture (not particularly illustrated) in the implement or attachment, such as an in an angle broom attachment as illustrated in FIG. 5 or in a combo bucket attachment as illustrated in FIG. 6. Wedge 62 includes a shaft portion that is hidden from view by guide plate 60.

The upper end of the shaft portion of wedge 62 is pivotally mounted to a wedge actuator shaft assembly 64. Wedge actuator shaft assembly 64 includes a shaft 65 (only one shaft is shown in FIG. 4) at the lower end. Shaft 65 has a bifurcated end that receives a pivot pin 66 (only one pivot pin is shown in FIG. 4) used for coupling shaft 65 to the end of the shaft portion of wedge 62. A coupling end 68 is connected to a shaft member 70 that is slidably coupled to shaft 65. A spring 72 acts between shaft 65 and coupling end 68. Such an arrangement of spring 72 will load wedge 62 downward into a locking position as well as upward into an unlocking position. The upper ends of each wedge actuator shaft assembly 64 are connected to a corresponding lever 74 or 75. Levers 74 and 75 are pivotally mounted to implement coupler 38 on pivot supports. Wedge actuator shaft assemblies 64 and wedges 62 are identical on opposite sides of implement coupler 38, except one lever is right-handed and the other lever is left-handed. In an engaged position as illustrated in FIGS. 3 and 4, levers 74 and 75 actuate wedges 62 in a downward direction through corresponding apertures in an implement for attaching the implement to the implement coupler 38. In a disengaged position (not illustrated), levers 74 and 75 actuate wedges 62 in an upward direction such that the wedges are withdrawn from the apertures in an implement.

Each lever 74 and 75 includes a handle 77 and 79 for manual operation of wedges 62. However, as illustrated in FIG. 4, wedge actuator shaft assemblies 64 and wedges 62 can be power actuated by an operator in an operator support structure 18 (FIG. 1) of upper frame 16 (FIG. 1) instead of manually actuated. The power actuation can be accomplished with the use of a hydraulic actuator 80. However, other types of power actuation besides a hydraulic actuator can be used.

FIGS. 5 and 6 illustrate perspective views of a compact excavator 10 including an implement attached to implement coupler 38 in accordance with embodiments of the present invention. FIG. 5 illustrates an angle broom attachment 76. Angle broom attachment 76 includes rotary broom 78, main plate 81, upper flange 82 and lower flange 84. Flanges 82 and 84 are configured to fit with implement coupler 38. In addition, lower flange 84 includes a pair of apertures configured to receive the pair of wedges of implement coupler 38. FIG. 6 illustrates a bucket attachment 86. Bucket attachment 86 includes a bucket 88, a main plate 90, an upper flange 92 and a lower flange (not shown in FIG. 6). The flanges are configured to fit with implement coupler 38. In addition, the lower flange includes a pair of apertures configured to receive the pair of wedges of implement coupler 38. Examples of other types of implements or attachments include a six-way blade, a trencher, a pallet fork and a standard dozer blade. However, those skilled in the art will recognize that this is not an exhaustive list of implements. Other implements can be used.

Embodiments of the present invention allow many types of implements to be attached to an implement assembly coupled to a base frame of a compact excavator. Such versatility does not limit an operator to the conventional excavating task of a compact excavator. The compact excavator of the present invention can be used in a variety of tasks and projects.

Although the present invention has been described with reference to preferred embodiments, workers skilled in the art will recognize that changes may be made in form and detail without departing from the spirit and scope of the invention.

What is claimed is:

1. A compact excavator comprising:

a base frame supported by first and second track assemblies, the first and second track assemblies directly connected to opposing sides of the base frame;

an upper frame attached to and positioned above the base frame and rotatable with respect to the base frame about a vertical axis;

an operator support portion coupled to the upper frame;

a first implement assembly coupled to the upper frame, with the first implement assembly capable of rotating about the vertical axis and including one of a plurality of different implements;

a second implement assembly coupled to the base frame at a position such that the second implement assembly is incapable of rotating about the vertical axis with respect to the base frame and the first and second track assemblies, the second implement assembly comprising:

a lift arm assembly pivotally mounted to a first side of the base frame at a lift arm pivot axis and extending from the lift arm pivot axis in a direction outwardly from the first side of the base frame, the lift arm assembly including:

a lift arm body having a first lift arm, a second lift arm and a cross-support member coupling the first and second lift arms;

at least one lift arm actuator coupled to the lift arm body and to the base frame of the compact excavator below the operator support portion, the at least one lift arm actuator configured to move the lift arm assembly about the lift arm pivot axis;

an implement coupler pivotally coupled to the lift arm assembly at an implement coupler pivot axis, the implement coupler configured to accept and be detachably secured to one of a plurality of different implements; and at least one tilt actuator coupled from the implement coupler to the cross-support member of the lift arm assembly between the first lift arm and the second lift arm, the tilt actuator configured to move the implement coupler about the implement coupler pivot axis.

2. The compact excavator of claim 1, wherein the at least one lift arm actuator comprises a hydraulic actuator having a base end coupled to the base frame and a rod end coupled to the lift arm body.

3. The compact excavator of claim 1, wherein the tilt actuator comprises a hydraulic actuator having a base end coupled to the cross-support member of the lift arm body and a rod end coupled to the implement coupler.

4. The compact excavator of claim 1, wherein the implement coupler comprises a pair of wedge actuator shaft assemblies coupled to a pair of wedges, wherein each wedge actuator shaft assembly includes a spring configured to load each wedge into a locking position and an unlocking position.

5. The compact excavator of claim 4, wherein each wedge actuator shaft assembly is pivotally coupled to a lever, each lever is configured to actuate each wedge in a downward direction for engaging an implement and actuating each wedge in an upward direction for disengaging the implement.

6. The compact excavator of claim 5, wherein each lever is coupled to a handle, each handle is configured to manually actuate each lever and therefore each wedge.

7. The compact excavator of claim 4, wherein the implement comprises an upper flange and a lower flange connected to a main plate, the upper flange configured to fit with a lip of the implement coupler.

8. An implement assembly for a compact excavator having a base frame supporting first and second track assemblies that are directly connected to opposing sides of the base frame and an upper frame rotatable about a vertical axis with respect to the base frame that includes an operator support structure coupled to and positioned above the base frame and an arm to which an implement can be attached, the implement assembly comprising:

a lift arm assembly pivotally mounted to a first side of the base frame at a lift arm pivot axis and extending from the lift arm pivot axis in a direction outwardly from the first side of the base frame, the lift arm assembly mounted to the base frame at a position such that the lift arm assembly is incapable of rotating about the vertical axis with respect to the base frame and the first and second track assemblies, the lift arm assembly comprising:

a lift arm body having a first lift arm, a second lift arm and a cross-support member coupling the first and second lift arms;

at least one lift arm actuator coupled to the lift arm body and to the base frame at a location below the operator compartment of the compact excavator to move the lift arm assembly about the lift arm pivot axis;

an implement coupler pivotally coupled to the lift arm body of the lift arm assembly at an implement coupler pivot axis, the implement coupler configured to latch an implement to the lift arm assembly; and at least one tilt actuator coupled from the implement coupler to the cross-support member of the lift arm body between the first lift arm and the second lift arm and configured to move the implement coupler about the implement coupler pivotal axis.

9. The implement assembly of claim 8, wherein the at least one lift arm actuator includes first and second lift arm hydraulic actuators.

10. The implement assembly of claim 9, wherein the first and second lift arm hydraulic actuators comprise base ends coupled to the base frame of the compact excavator and rod ends coupled to one of the first lift arm and the second lift arm of the lift arm body.

11. The implement assembly of claim 9, wherein the first and second lift arm hydraulic actuators are controlled by an operator located within an operator support portion of a compact excavator.

12. The implement assembly of claim 8, wherein the at least one tilt actuator is controlled by an operator located within an operator support structure of a compact excavator.

13. The implement assembly of claim 8, wherein the implement coupler comprises a pair of wedge actuator shaft assemblies coupled to a pair of wedges, wherein each wedge actuator shaft assembly includes a spring configured to load each wedge into a locking position and an unlocking position.

14. The implement assembly of claim 13, wherein each wedge actuator shaft assembly is pivotally coupled to a lever, each lever is configured to actuate each wedge in a downward direction for engaging an implement and actuate each wedge in an upward direction for disengaging the implement.

15. The implement assembly of claim 14, wherein each lever is coupled to a handle, each handle is configured to manually actuate each lever and therefore each wedge.

16. The implement assembly of claim 8, wherein the implement comprises an upper flange and a lower flange connected to a main plate, the upper flange configured to fit with a lip of the implement coupler.

* * * * *